US010549166B1

(12) United States Patent
Mueller et al.

(10) Patent No.: US 10,549,166 B1
(45) Date of Patent: Feb. 4, 2020

(54) BATTING TRAINING

(71) Applicants: Lukas D. Mueller, Hackensack, NJ (US); Daniel R. O'Brien, Emerson, NJ (US)

(72) Inventors: Lukas D. Mueller, Hackensack, NJ (US); Daniel R. O'Brien, Emerson, NJ (US)

( * ) Notice: Subject to any disclaimer, the term of this patent is extended or adjusted under 35 U.S.C. 154(b) by 0 days.

(21) Appl. No.: 16/006,997

(22) Filed: Jun. 13, 2018

(51) Int. Cl.
*A63B 71/00* (2006.01)
*A63B 69/00* (2006.01)
*A63B 102/18* (2015.01)

(52) U.S. Cl.
CPC ..... *A63B 69/0002* (2013.01); *A63B 69/0075* (2013.01); *A63B 2069/0008* (2013.01); *A63B 2102/18* (2015.10)

(58) Field of Classification Search
CPC . A63B 69/0075; A63B 69/0002; A63B 71/06; A63B 43/06; A63B 69/0073; A63B 24/00; A63B 69/0053; A63B 69/38
USPC ..... 473/417, 422, 451, 431, 453, 284, 386, 473/387; D21/698, 699, 705, 707–709, D21/713–718, 780
See application file for complete search history.

(56) References Cited

U.S. PATENT DOCUMENTS 4,461,477 A * 7/1984 Stewart ..... A63B 69/0002 434/247
4,834,375 A * 5/1989 Elstein ..... A63B 24/00 473/417
5,042,814 A 8/1991 Bennett
7,169,067 B2 * 1/2007 Town ..... A63B 69/0002 473/417
7,513,833 B1 4/2009 Town
7,887,441 B1 * 2/2011 Archer ..... A63B 43/06 473/417
8,465,377 B1 6/2013 Kamnikar et al.
8,790,190 B2 7/2014 Kamnikar et al.
9,272,195 B2 3/2016 Argiro et al.
9,442,633 B2 9/2016 Dyer et al.
9,770,638 B2 * 9/2017 Argiro ..... A63B 69/0075 473/417
D810,214 S * 2/2018 Su ..... D21/717
10,112,097 B2 * 10/2018 LoDuca ..... A63B 69/0075 473/417
(Continued)

*Primary Examiner* — Mitra Aryanpour
(74) *Attorney, Agent, or Firm* — Arthur Jacob

(57) ABSTRACT

Apparatus and method train a batter to maintain the batter's eyes directed toward a prescribed point of contact where a ball is to be contacted by a bat wielded by the batter during a swing of the bat. A batting tee holds the ball, and a plurality of visually distinct signals on the tee are located such that the signals are blocked from view by the batter when the ball is in place on the tee, and are visible by the batter when the ball is struck from the tee and the batter's eyes are directed toward the point of contact as the ball leaves the tee. A trainer at a remote location manually activates the signals, enabling the selection of one or a combination of signals for viewing by the batter when the batter's eyes are directed toward the point of contact as the ball leaves the tee, allowing verification of the activated signal or signals by the batter as the ball leaves the batting tee, thereby determining if, in fact, the batter's eyes were directed toward the point of contact when the ball departed the batting tee, thus enabling evaluation of the batter's training progress.

17 Claims, 3 Drawing Sheets

(56) References Cited

U.S. PATENT DOCUMENTS

| | | | | |
|---|---|---|---|---|
| 2003/0069092 | A1* | 4/2003 | Gowan | A63B 69/407<br>473/416 |
| 2006/0035730 | A1* | 2/2006 | Nguyen | A63B 69/0073<br>473/417 |
| 2006/0199670 | A1* | 9/2006 | Town | A63B 69/0002<br>473/417 |

* cited by examiner

BATTING TRAINING

The present invention relates generally to batting training and pertains, more specifically, to apparatus and method for training a batter to maintain the batter's eyes directed toward a point of contact where a ball is to be contacted by a bat wielded by the batter during a swing of the bat.

In the conduct of the game of baseball, accuracy is demanded of a batter in addressing a pitched ball in order to execute an effective hit. Such requisite accuracy is gained by the batter through keeping the batter's eyes directed toward a prescribed point of contact between the bat and the pitched ball during a successful hit. Many batters have a tendency to raise the batter's head as a swing is executed, thereby moving the batter's head and, consequently, the batter's eyes, away from concentration upon the most effective point of contact, leading to missing the ball completely or, at least, to misdirecting the ball, perhaps even into foul territory.

The present invention provides an apparatus and a method for training a batter to keep his or her head down so that the batter's eyes are maintained directed toward the point of contact where the bat will make best contact with the ball during the completion of a full swing for a truly effective hit. As such, the present invention attains several objects and advantages, some of which are summarized as follows: Provides a simple, highly effective apparatus and method for training a batter to maintain the batter's eyes directed toward a prescribed point of contact between a bat and a ball for completing an exemplary hit; enables live observation by a trainer, coupled with manual control and individual coaching during a training session for more effective training of a batter; provides a relatively inexpensive apparatus arranged for ease of use in improving a batter's performance; enables increased versatility in providing effective coaching during batting training sessions; makes available effective, practical batter training to a wider audience of potential batters; allows immediate evaluation of a batter's progress during a training session, enabling appropriate adjustments to accommodate a particular batter during a training session; provides a relatively inexpensive, versatile apparatus capable of widespread use and exemplary performance over an extended service life.

The above objects and advantages, as well as further objects and advantages, are attained by the present invention which may be described briefly as an apparatus for training a batter to maintain the batter's eyes directed toward a point of contact where a ball is to be contacted by a bat wielded by the batter during a swing of the bat, the apparatus comprising: a batting tee for placement at a batting location, the batting tee having a ball holder for locating a ball in a batting position wherein the ball is to be contacted by a bat swung by a batter in a batter position at the batting location; the ball holder including a ball support for receiving a ball placed in the batting position within the ball holder, with the ball located for contact by the bat at a prescribed point of contact; a plurality of distinct signals carried on the batting tee, each signal when activated being visually distinguished from the remaining signals of the plurality of signals, the plurality of signals being located relative to the ball support such that the signals are blocked from view by the batter in the batter position when the ball is in place, located in the batting position on the ball support, and are visible by the batter when (a) the ball is struck from the ball support, and (b) the batter's eyes are directed toward the point of contact as the ball is struck from the ball support; and a control arrangement including a manually operated controller for placement at a controller location remote from the batting location for manual selective activation of the signals, enabling a trainer, located at the remote controller location, manually to select any one signal or any combination of the plurality of signals for activation and viewing by the batter when the batter's eyes are directed toward the point of contact as the ball is struck from the ball support, enabling the trainer to require from the batter verification of the activated signal or combination of signals made available for viewing by the batter as the ball is struck from the ball support, thereby determining whether the batter's eyes were directed toward the point of contact when the ball was struck from the ball support, for enabling evaluation of the progress of the batter's training.

In addition, the present invention provides a method for training a batter to maintain the batter's eyes directed toward a point of contact where a ball is to be contacted by a bat wielded by the batter placed at a batter position during a swing of the bat, the method comprising: placing a batting tee at a batting location; providing a ball support on the batting tee wherein a supported ball is to be contacted by a bat swung by a batter placed at the batter position, with the supported ball located for contact by the bat at a prescribed point of contact; placing a plurality of distinct signals on the batting tee, each signal when activated being visually distinguished from the remaining signals of the plurality of signals; locating the plurality of signals relative to the ball support such that the signals are blocked from view by the batter when the ball is in place, located on the ball support, and are visible by the batter when (a) the ball is struck from the ball support, and (b) the batter's eyes are directed toward the point of contact as the ball is struck from the ball support; placing a manually operated controller at a controller location remote from the batting location for manual selective activation of the signals; (1) placing a ball on the ball support; (2) operating the controller at the remote controller location, manually to select any one signal or any combination of the plurality of signals for activation for an interval of selected duration so as to be available for viewing by the batter during that interval and when the batter's eyes are directed toward the point of contact as the ball is struck from the ball support; (3) instructing the batter to execute a swing of the bat to strike the ball from the ball support, thereby opening a line of sight extending from the batter position to the plurality of distinct signals; (4) requiring identification by the batter of the activated signal or combination of signals made available for viewing by the batter as the ball is struck from the ball support, thereby determining whether the batter's eyes were directed toward the point of contact when the ball was struck from the ball support, enabling evaluation of the batter's training progress.

The invention will be understood more fully, while still further objects and advantages will become apparent, in the following detailed description of preferred embodiments of the invention illustrated in the accompanying drawing, in which.

Figure 1:
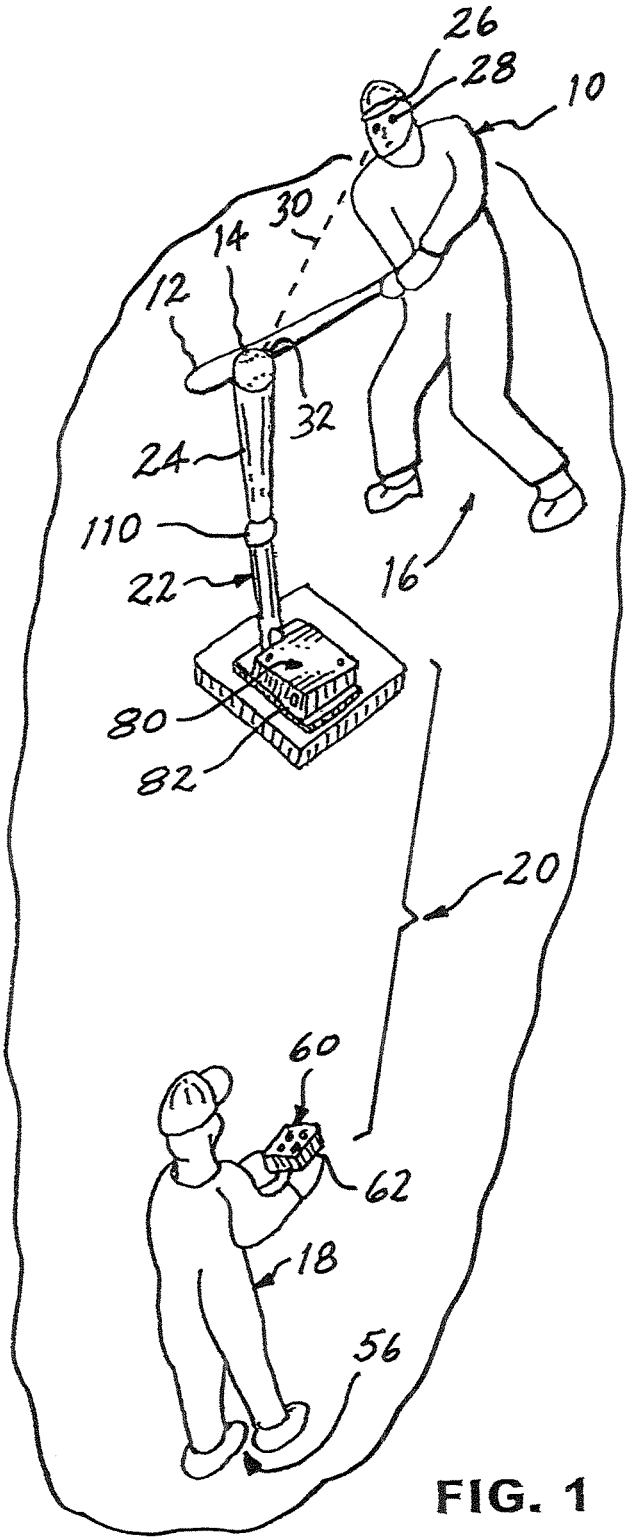
FIG. 1 is a pictorial view showing an apparatus constructed in accordance with the present invention in use in conducting a method of the present invention.

Referring now to the drawing, and especially to FIG. 1 thereof, there is illustrated a batting training session in which a batter 10 wields a bat 12 to address a ball 14 when the batter 10 is placed at a batter position 16, while being observed by a trainer 18. An apparatus constructed in accordance with the present invention is shown at 20 and is seen to include a batting tee 22 having a ball holder 24 for locating ball 14 in a batting position wherein the ball 14 is to be contacted by the bat 12 as the bat 12 is swung by batter 10. The batter 10 is shown in a preferred stance in which the batter's head 26 is tilted slightly downwardly so that the batter's eyes 28 are directed, as illustrated by dashed line of sight 30, toward a prescribed point of contact 32 where the ball 14 is to be contacted by the bat 12 during the batter's swing for the execution of an exemplary hit.

Figure 2:
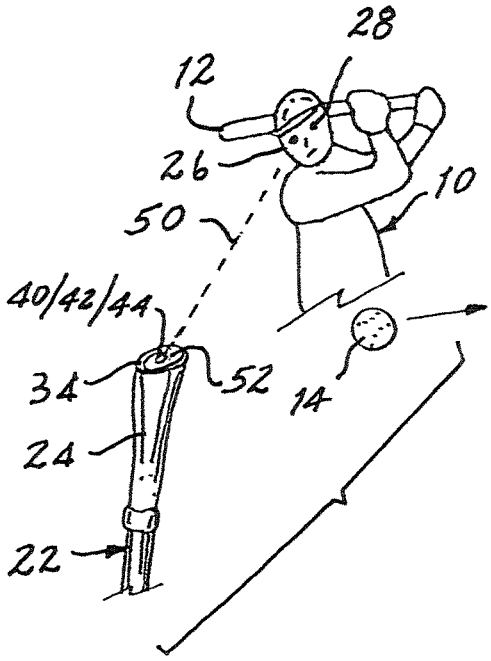
FIG. 2 is a fragmentary pictorial view illustrating a further step in a method conducted in accordance with the present invention.
Figure 3:
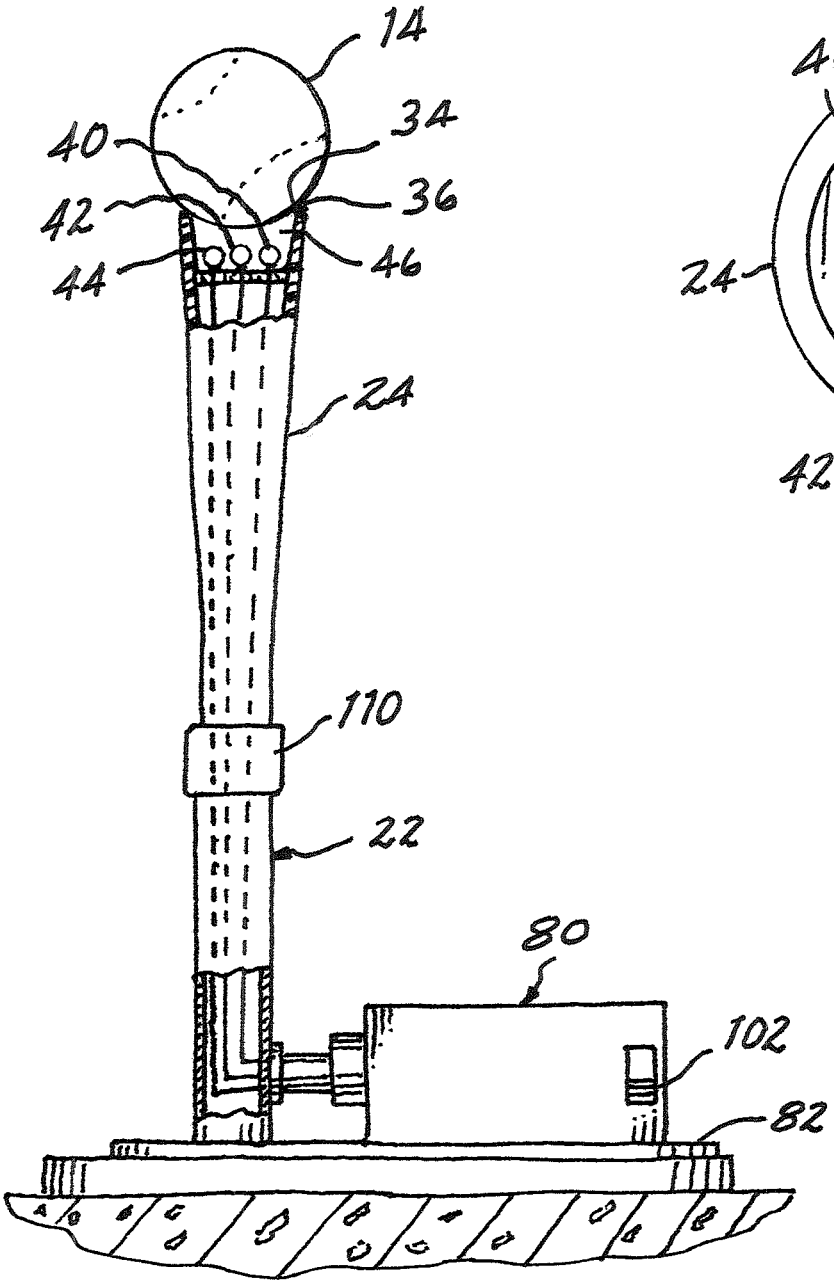
FIG. 3 is a side elevational view of a component of the apparatus shown in FIG. 1.
Figure 4:
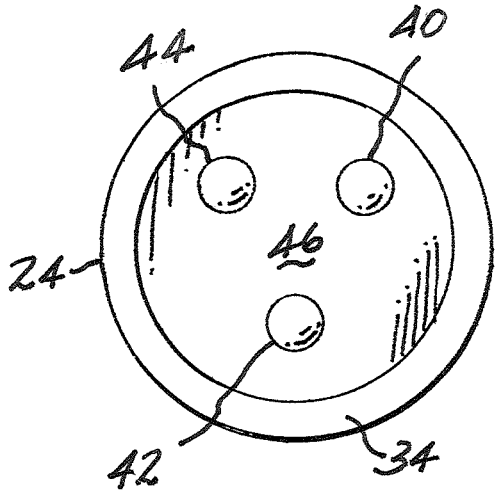
FIG. 4 is an enlarged top plan view of a portion of the component shown in FIG. 3.

Turning now to FIGS. 2 through 4, ball holder 24 includes a ball support 34 for receiving ball 14 placed in batting position 36 within the ball holder 24, with the ball 12 located for contact by the bat 14 at the prescribed point of contact 32. Batting tee 22 carries a plurality of distinct signals, preferably in the form of lights, shown as three LEDs 40, 42, and 44, located in a chamber 46 within the ball holder 24, below the ball support 34, such that the LEDs 40, 42 and 44 are blocked from view by the batter 10 when the ball 14 is in place, located on the ball support 34, as illustrated in FIG. 3, and become visible to the batter 10 once the ball 14 is struck from the ball support 34, provided the batter's eyes 28 remain directed in the direction illustrated by line of sight 30, so as now to be directed along dashed line of sight 50, which coincides with the direction of line of sight 30 and leads from the batter's eyes 28 toward a viewing location 52 where the now exposed LEDs 40, 42 and 44 are revealed, as seen in FIG. 2. In a preferred construction, ball holder 24 is fabricated of an elastomeric material so as to be rendered resiliently flexible for withstanding any impact that might be received by a misdirected swung bat 12.

Figure 5:
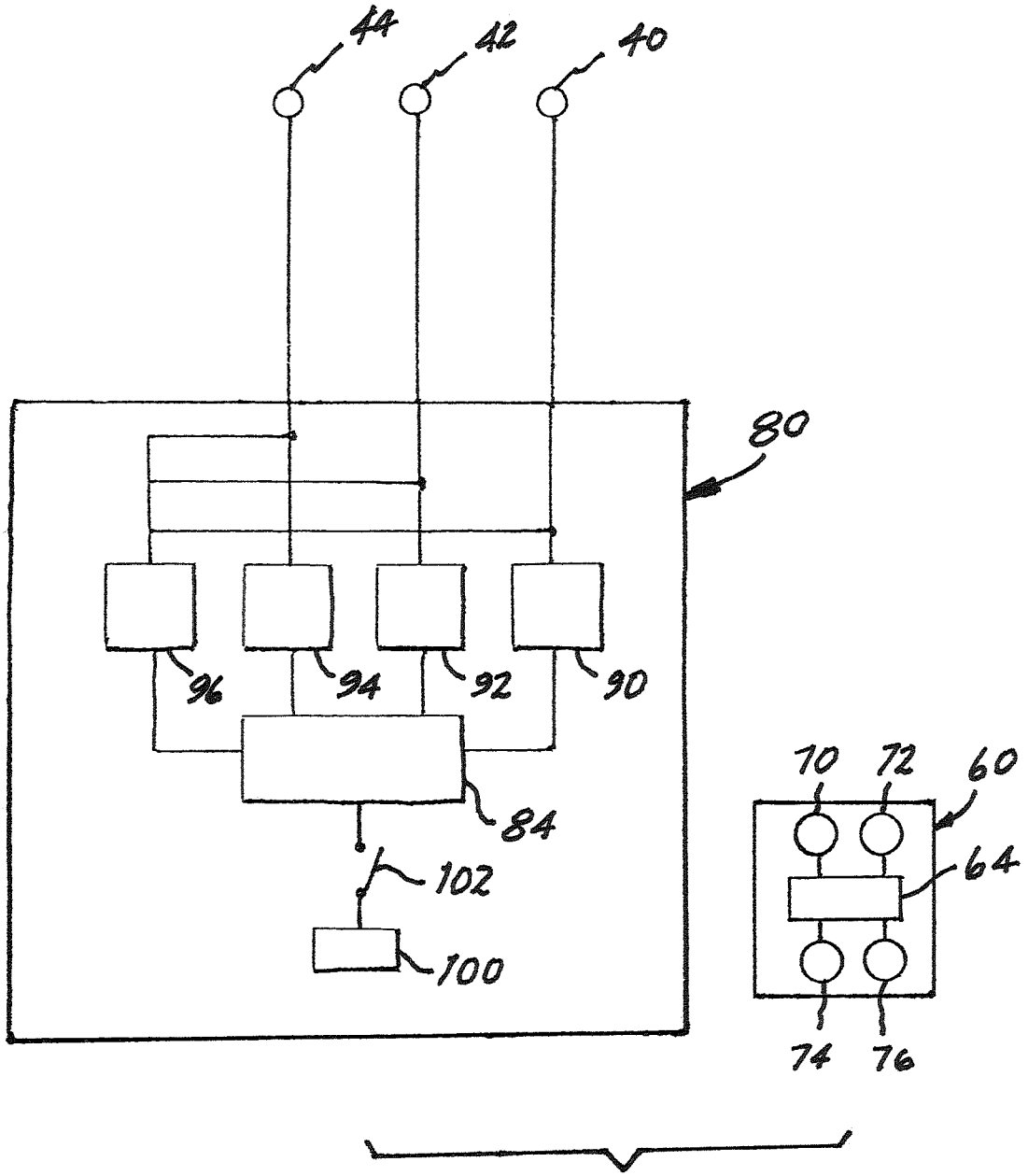
FIG. 5 is a diagrammatic illustration of components of the apparatus depicted in FIG. 1.

With reference now to FIGS. 1 and 5, as well as to FIGS. 2 through 4, trainer 18 is posted at a trainer location 56 remote from batting tee 22 and batter 10 at batter position 16, and operates a control arrangement that includes a manually operated controller, shown in the form of a keypad 60 placed at a controller location 62 remote from the batting tee 22 by virtue of the remote trainer location 56 of trainer 18, at which remote trainer location 56 trainer 18 is able to observe the batter 10 during the batter's swing. In the preferred construction, keypad 60 includes a four-channel wireless transmitter 64 operated in response to four selectively actuated keys 70, 72, 74 and 76 of keypad 60. The control arrangement further includes a control unit, shown in the form of a control box 80 placed at the base 82 of the batting tee 22. Control box 80 houses a four-channel wireless receiver 84 coupled to three relays 90, 92 and 94, each relay 90, 92 and 94 being, in turn, connected to a corresponding LED 40, 42 and 44. A fourth relay 96, also coupled to wireless receiver 84, is connected to all three of the LEDs 40, 42 and 44. Thus, in response to depression of a selected key 70, 72 or 74, or a combination of keys 70, 72 and 74, a corresponding LED 40, 42 or 44, or a corresponding combination of LEDs 40, 42 and 44, will be illuminated and will remain illuminated for as long as each key 70, 72 or 74 remains depressed. In response to depression of fourth key 76, all three of the LEDs 40, 42 and 44 will be illuminated and remain illuminated as long as key 76 remains depressed. The system of receiver 84, relays 90, 92, 94 and 96 and LEDs 40, 42 and 44 is powered by a battery 100 selectively connected through an on/off switch 102, both the battery 100 and the switch 102 being located at the control box 80.

Each one of the LEDs 40, 42 and 44 has a distinct visible identification easily recognized by the batter 10 upon becoming visible by the batter 10. Thus, in a preferred arrangement, each LED 40, 42 and 44, upon illumination, is provided with a distinct color, for example, LED 40 is red, LED 42 is blue, and LED 44 is yellow. Alternate distinguishing features, visible upon illumination, are feasible, such as shape, relative size and location of each LED 40, 42 and 44.

A typical training session is conducted as follows: A ball 14 is placed upon the ball support 34, a batter 10 takes batting position 16 adjacent the batting tee 22, as illustrated in FIG. 1, and the elevation of the ball support 34 and, consequently, the ball 14 is adjusted, utilizing a conventional height adjustment arrangement 110 available in the batting tee 22, to establish the location of a requisite point of contact 32. The wireless receiver 84 is powered by closing switch 102, the trainer 18 takes a position at remote location 56, and the batter 10 assumes an appropriate stance, addressing the ball 14, with the batter's head 26 tilted downwardly so as to direct the batter's eyes 28 along line of sight 30 toward the point of contact 32, all as seen in FIG. 1. Then, the trainer 18 operates the keypad 60 to select one key 70, 72 or 74, or a combination of keys 70, 72 and 74, to illuminate a selected LED 40, 42 or 44, or a selected combination of LEDs 40, 42 and 44, or key 76 to illuminate all LEDs 40, 42 and 44, while, at the same time, instructing the batter 10 to execute a swing of the bat 12 to strike the ball 14. Immediately after striking the ball 14 from the ball support 34, the batter 10 is required to call out to the trainer 18 the identity of the illuminated LED 40, 42 or 44, or the combination of illuminated LEDs 40, 42 and 44, which now becomes visible to the batter 10 if, indeed, the batter's head 26 is tilted downwardly so that the batter's eyes 28, originally directed along line of sight 30 toward point of contact 32, now continue to be directed along line of sight 50 toward the now visible illuminated LED 40, 42 or 44, or combination of illuminated LEDs 40, 42 and 44 at the viewing location 52, as illustrated in FIG. 2. In this manner, the trainer 18 is able to determine if, in fact, the batter 10 did, indeed, maintain the batter's eyes 28 directed toward the point of contact 32 when the ball 14 was struck from the ball support 34, and immediately thereafter.

The trainer 18 maintains manual control over the duration of the interval of time during which the selected LED 40, 42 or 44, or combination of LEDs 40, 42 and 44 remains illuminated by manually maintaining a corresponding key 70, 72, 74 or 76 or combination of keys 70, 72 and 74 depressed. As the batter 10 becomes more adept at maintaining the batter's eyes 28 directed toward the point of contact 32 as the ball 14 is driven from the ball support 34, the trainer 18 can evaluate the batter's performance and will adjust the duration of this interval of time during each subsequent swing of the bat 12 in a series of swings executed by a batter 10 during a training session, the adjustment being based upon the training progress made by the batter 10 in batting performance, as observed by the trainer 18. As a batter 10 becomes more adept, the trainer 18 can decrease the duration of the interval, thereby assuring that the batter 10 observed the selected illuminated LED 40, 42 or 44, or combination of LEDs 40, 42 or 44, immediately upon striking the ball 14 from the ball support 34, prompting a concomitant increase in the batter's skill. In this manner, the trainer 18 is able to coach the batter 10 toward executing a proper, fully effective swing of the bat 12 to complete an exemplary hit. The arrangement whereby a live trainer 18 can provide positive coaching feedback to the batter 10, coupled with instant adjustments by the trainer 18 to accomplish a well-defined training goal enables simplicity, both in training apparatus and in training method, for widespread practical implementation.

It will be seen that the present invention attains all of the objects and advantages summarized above, namely: Provides a simple, highly effective apparatus and method for training a batter to maintain the batter's eyes directed toward a prescribed point of contact between a bat and a ball for completing an exemplary hit; enables live observation by a trainer coupled with manual control and individual coaching during a training session for more effective training of a batter, provides a relatively inexpensive apparatus arranged for ease of use in improving a batter's performance; enables increased versatility in providing effective coaching during batting training sessions; makes available effective, practical batter training to a wider audience of potential batters; allows immediate evaluation of a batter's progress during a training session, enabling appropriate adjustments to accommodate a particular batter during a training session; provides a relatively inexpensive, versatile apparatus capable of widespread use and exemplary performance over an extended service life.

It is to be understood that the above detailed description of preferred embodiments of the invention is provided by way of example only. Various details of design, construction and procedure may be modified without departing from the true spirit and scope of the invention as set forth in the appended claims.

The embodiments of the invention in which an exclusive property or privilege is claimed are defined as follows:

1. An apparatus for training a batter to maintain the batter's eyes directed toward a point of contact where a ball is to be contacted by a bat wielded by the batter during a swing of the bat, the apparatus comprising:

a batting tee for placement at a batting location, the batting tee having a ball holder for locating a ball in a batting position wherein the ball is to be contacted by a bat swung by a batter in a batter position at the batting location;

the ball holder including a ball support for receiving a ball placed in the batting position within the ball holder, with the ball located for contact by the bat at a prescribed point of contact;

a plurality of distinct signals carried on the batting tee, each signal when activated being visually distinguished from the remaining signals of the plurality of signals, the plurality of signals being located relative to the ball support such that the signals are blocked from view by the batter in the batter position when the ball is in place, located in the batting position on the ball support, and are visible by the batter when (a) the ball is struck from the ball support, and (b) the batter's eyes are directed toward the point of contact as the ball is struck from the ball support; and a control arrangement including a manually operated controller for placement at a controller location remote from the batting location for manual selective activation of the signals, enabling a trainer, located at the remote controller location, manually to select any one signal or any combination of the plurality of signals for activation and viewing by the batter when the batter's eyes are directed toward the point of contact as the ball is struck from the ball support, enabling the trainer to require from the batter verification of the activated signal or combination of signals made available for viewing by the batter as the ball is struck from the ball support, thereby determining whether the batter's eyes were directed toward the point of contact when the ball was struck from the ball support, for enabling evaluation of the progress of the batter's training.

2. The apparatus of claim 1 wherein the plurality of distinct signals is placed within the ball holder, below the ball support, at a viewing location viewable along a line of sight extending from the batter position to the viewing location when the ball is struck from the ball support.

3. The apparatus of claim 1 wherein each signal comprises a light arranged for illumination when activated in response to operation of the controller.

4. The apparatus of claim 3 wherein each light comprises an LED.

5. The apparatus of claim 3 wherein each light of the plurality of lights when illuminated displays a color, the color displayed by each light being visually distinct from the color displayed by each of the remaining lights of the plurality of lights.

6. The apparatus of claim 5 wherein each light comprises an LED.

7. The apparatus of claim 1 wherein the control arrangement includes a control unit placed at the batting location, the controller includes a wireless transmitter for selective operation by the trainer, and the control unit includes a wireless receiver for operation in response to operation of the controller, the wireless receiver being coupled to the plurality of signals for selective activation of any one or any combination of the plurality of signals in response to operation of the controller.

8. The apparatus of claim 7 wherein the plurality of distinct signals is placed within the ball holder, below the ball support, at a viewing location viewable along a line of sight extending from the batter position to the viewing location when the ball is struck from the ball support.

9. The apparatus of claim 7 wherein each signal comprises a light arranged for illumination when activated in response to operation of the controller.

10. The apparatus of claim 9 wherein each light comprises an LED.

11. The apparatus of claim 9 wherein each light of the plurality of lights when illuminated displays a color, the color displayed by each light being visually distinct from the color displayed by each of the remaining lights of the plurality of lights.

12. The apparatus of claim 11 wherein each light comprises an LED.

13. A method for training a batter to maintain the batter's eyes directed toward a point of contact where a ball is to be contacted by a bat wielded by the batter placed at a batter position during a swing of the bat, the method comprising:

placing a batting tee at a batting location;

providing a ball support on the batting tee wherein a supported ball is to be contacted by a bat swung by a batter placed at the batter position, with the supported ball located for contact by the bat at a prescribed point of contact;

placing a plurality of distinct signals on the batting tee, each signal when activated being visually distinguished from the remaining signals of the plurality of signals;

locating the plurality of signals relative to the ball support such that the signals are blocked from view by the batter when the ball is in place, located on the ball support, and are visible by the batter when (a) the ball is struck from the ball support, and (b) the batter's eyes are directed toward the point of contact as the ball is struck from the ball support;

placing a manually operated controller at a controller location remote from the batting location for manual selective activation of the signals;

(1) placing a ball on the ball support;

(2) operating the controller at the remote controller location, manually to select any one signal or any combination of the plurality of signals for activation for an interval of selected duration so as to be available for viewing by the batter during that interval and when the batter's eyes are directed toward the point of contact as the ball is struck from the ball support;

(3) instructing the batter to execute a swing of the bat to strike the ball from the ball support, thereby opening a line of sight extending from the batter position to the plurality of distinct signals;

(4) requiring identification by the batter of the activated signal or combination of signals made available for viewing by the batter as the ball is struck from the ball support, thereby determining whether the batter's eyes were directed toward the point of contact when the ball was struck from the ball support, enabling evaluation of the batter's training progress.

14. The method of claim 13 including repeating, as necessary, steps (1) through (4) until eliciting from the batter identification of the activated signal or combination of signals, enabling a determination that the batter's eyes were directed toward the point of contact when the ball was struck from the ball support.

15. The method of claim 14 wherein activation of a selected signal or combination of signals includes illuminating a selected light or combination of lights for viewing by the batter.

16. The method of claim 15 wherein illuminating a selected light or combination of lights includes selecting a distinctive color for the selected illuminated light and selecting a combination of visually different distinctive colors for the illuminated combination of lights.

17. The method of claim 13 including repeating step (2) through consecutive intervals of progressively decreasing duration based upon a determination of the batter's training progress.

* * * * *